US010368578B2

(12) United States Patent
Bigelow et al.

(10) Patent No.: US 10,368,578 B2
(45) Date of Patent: Aug. 6, 2019

(54) METHOD AND SYSTEM FOR USING AN INNER PACK FRAME TO CONTAIN LOOSE ELONGATED SMOKING ARTICLES IN A HINGE LID PACK

(71) Applicant: ALTRIA CLIENT SERVICES INC., Richmond, VA (US)

(72) Inventors: James S. Bigelow, Midlothian, VA (US); Mary B. Pettit, Richmond, VA (US); Jennifer N. Lewis, Chesterfield, VA (US)

(73) Assignee: Altria Client Services LLC, Richmond, VA (US)

( * ) Notice: Subject to any disclaimer, the term of this patent is extended or adjusted under 35 U.S.C. 154(b) by 222 days.

(21) Appl. No.: 14/790,332

(22) Filed: Jul. 2, 2015

(65) Prior Publication Data

US 2016/0000144 A1 Jan. 7, 2016

Related U.S. Application Data

(60) Provisional application No. 62/020,650, filed on Jul. 3, 2014.

(51) Int. Cl.
*A24F 23/00* (2006.01)
*B65B 19/20* (2006.01)

(52) U.S. Cl.
CPC ..... *A24F 23/00* (2013.01); *B65B 19/20* (2013.01)

(58) Field of Classification Search
USPC ..... 206/256, 257, 258, 271, 273, 264
See application file for complete search history.

(56) References Cited

U.S. PATENT DOCUMENTS 4,949,841 A * 8/1990 Focke ..... B65D 85/1009 206/254
5,137,148 A * 8/1992 Evers ..... B65D 5/4233 206/271
5,150,720 A * 9/1992 Focke ..... B65D 85/1045 131/329
5,158,664 A * 10/1992 Colgan ..... B65D 85/1045 206/242
5,439,105 A * 8/1995 Focke ..... B65D 5/48048 206/256
5,558,217 A * 9/1996 Focke ..... B65D 85/109 206/265
5,896,984 A * 4/1999 Focke ..... B65D 5/6691 206/268
6,311,834 B1 * 11/2001 Focke ..... B65D 5/6691 206/268

(Continued)

*Primary Examiner* — Jacob K Ackun
(74) *Attorney, Agent, or Firm* — Buchanan Ingersoll & Rooney PC

(57) ABSTRACT

A method of manufacturing a hinge lid pack for containing loose elongated smoking articles is disclosed, the method includes forming a box and a lid connected to the box about a hinge line extending across a back wall of the pack. The box can include a front wall, a left side wall, a right side wall, a back wall, and a bottom wall, and the lid can include a lid top wall, a lid left side wall, a lid right side wall, and a lid back wall. A perforation line is formed in a front panel of an inner frame, the inner frame including the front panel, a right side panel, and a left side panel, and at least a portion of the inner frame is glued to the front wall of the box of the hinge lid pack.

3 Claims, 5 Drawing Sheets

(56) References Cited

U.S. PATENT DOCUMENTS

| | | | | |
|---|---|---|---|---|
| 7,290,652 | B2 * | 11/2007 | Rath | B65D 75/5827 206/242 |
| 7,717,260 | B2 * | 5/2010 | Buse | B65D 85/1045 206/242 |
| 7,832,556 | B2 * | 11/2010 | Ghini | B65D 85/1045 206/256 |
| 8,763,800 | B2 * | 7/2014 | Agirbas | B65D 5/5023 206/256 |
| 2008/0230410 | A1 * | 9/2008 | Steven Jones | B65D 5/4291 206/268 |

* cited by examiner

METHOD AND SYSTEM FOR USING AN INNER PACK FRAME TO CONTAIN LOOSE ELONGATED SMOKING ARTICLES IN A HINGE LID PACK

CROSS REFERENCE TO RELATED APPLICATION

This application claims priority under 35 U.S.C. § 119(e) to U.S. provisional Application No. 62/020,650, filed on Jul. 3, 2014, the entire content of which is incorporated herein by reference.

WORKING ENVIRONMENT

It is known to package consumer goods in hinge lid packs formed from folded laminar blanks. For example, elongated smoking articles, such as cigarettes and cigars, can be sold in hinge lid packs having a box for housing the smoking articles and a lid connected to the box about a hinge line extending across the back wall of the pack. Such packs can be typically constructed from one-piece laminar cardboard blanks. In use, the lid is pivoted about the hinge line to open the pack and so gain access to the smoking articles held in the box.

Hinge lid packs can be used for packaging cigarettes and other consumer goods, which can be adversely affected by prolonged contact with air or moisture. Prior to the first opening, a filled pack can be wrapped in an outer wrapper, which provides a barrier layer against the ingress or emersion of air, moisture, odors or flavors into and out of the pack during storage. Transparent plastic materials, such as polypropylene can be used for this purpose.

SUMMARY

A method of manufacturing a hinge lid pack for containing loose elongated smoking articles is disclosed, the method comprising: forming a box and a lid connected to the box about a hinge line extending across a back wall of the pack, the box having a front wall, a left side wall, a right side wall, a back wall, and a bottom wall, and the lid having a lid top wall, a lid left side wall, a lid right side wall, and a lid back wall; forming a perforation line in a front panel of an inner frame, the inner frame comprising the front panel, a right side panel, and a left side panel, and wherein the perforation line in the front panel is configured to allow at least one of the left or right side panels and a portion of the front panel of the inner frame to fold inward creating an inner cavity between the inner frame and the box of the hinge lid pack; and gluing at least a portion of the inner frame to the front wall of the box of the hinge lid pack.

A hinge lid pack is disclosed, the hinge lid pack comprising: a box and a lid, the box having a front wall, a left side wall, a right side wall, a back wall, and a bottom wall, and the lid having a lid top wall, a lid left side wall, a lid right side wall, and a lid back wall; and an inner frame mounted within the box, the inner frame having a front panel, a left side panel, and a right side panel, and wherein the inner frame includes a perforation line in the front panel, which is configured to allow at least one of the left or right side panels and a portion of the front panel to fold inward to create an inner cavity between the inner frame and the box.

An inner frame formed from a blank for use with a hinge lid pack is disclosed, the inner frame comprising: a front panel, a left side panel, a right side panel; and wherein the inner frame includes a perforation line in the front panel, which is configured to allow at least one of the left or right side panels and a portion of the front panel to fold inward to create an inner cavity between the inner frame and a box of the hinge lid pack.

BRIEF DESCRIPTION OF THE DRAWINGS

The disclosure is explained below with reference to the exemplary embodiments shown in the drawings. In the drawings.

DETAILED DESCRIPTION

Figure 1:
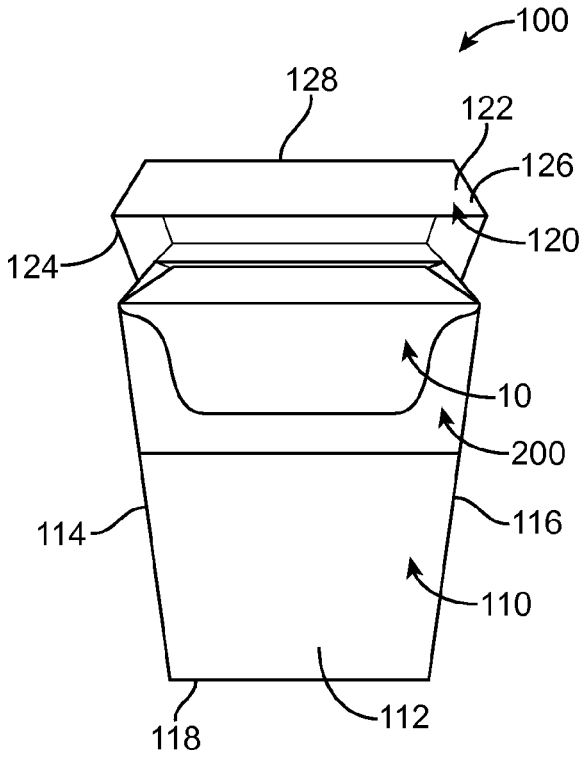
FIG. 1 is a perspective view of an assembled pack with an open lid showing an inner frame in accordance with an exemplary embodiment.

FIG. 1 is a perspective view of a hinged lid pack 100 with an open lid 120 showing an inner frame 200 in accordance with an exemplary embodiment. The hinge lid pack 100 as shown in FIG. 1 is preferably a rectangular parallelepiped formed from one or more laminar blanks and includes a box 110 and a lid 120. The lid 120 is hinged to the box 110 along a hinge line extending substantially horizontally along the back wall of the pack 100. A wrapped bundle of elongated smoking articles 10 can be housed in the box 110 of the pack 100.

The box 110 has a front wall 112, a left side wall 114, a right side wall 116, a back wall (not shown), and a bottom wall 118. The upper side of the box 110 is open, to provide an upper opening through which the cigarettes 10 can be removed. The lid 120 can include a lid front wall 122, a lid left side wall 124, a lid right side wall 126, and a lid back wall (not shown), and a lid top wall 128.

The terms "front," "back," "upper," "lower," "side," "top," "bottom," and other terms used to describe relative positions of the components of packs 100 according to an embodiment refer to the pack in an upright position with the lid 120 at the top end and the hinge on the back. The terms "left" and "right" are used with reference to side walls of the pack when the pack 100 is viewed from the front in its upright position. When the pack in the upright position is open, the elongated smoking articles 20 (FIG. 4), for example, cigarettes contained in the box 110 may be removed from the upper end of the pack 100.

Figure 2:
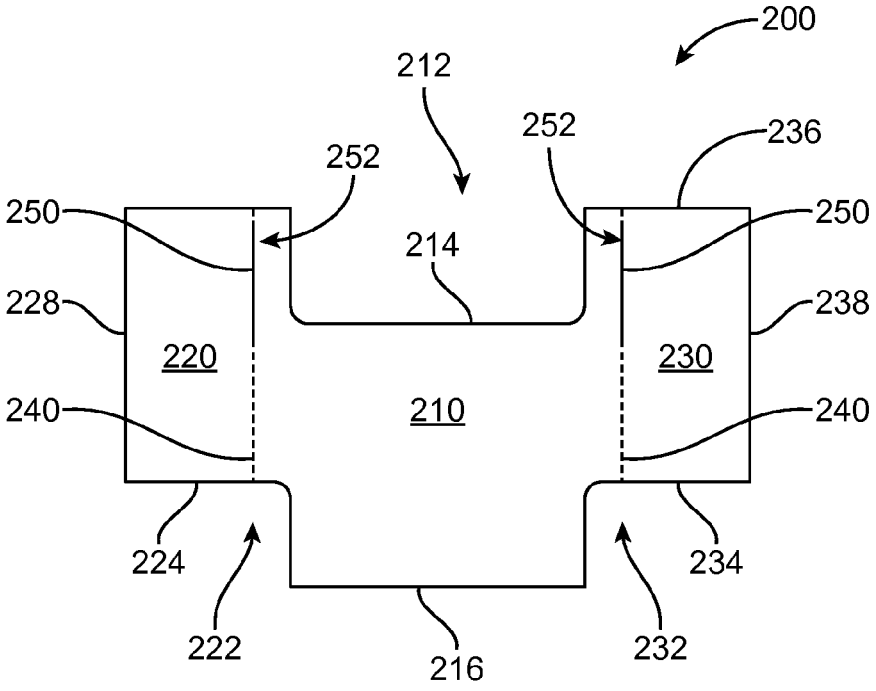
FIG. 2 is a plan view of an inner frame before assembly in accordance with an exemplary embodiment.

FIG. 2 is a plan view of an inner frame 200 before assembly in accordance with an exemplary embodiment. The inner frame 200 can include an inner frame front panel 210, an inner frame left side panel 220, and an inner frame right side panel 230, which upon assembly of the hinge-lid box are connected to the inner surface of the front wall 112, the left side wall 114, and the right side wall 116 of the box 110, respectively. The inner frame front panel 210 can include an upper rectangular cut out 212 at the top free edge 214 of the inner frame front panel 210 in order to facilitate removal of the elongated smoking articles 20 from the box 110. The inner frame 200 can also include rectangular cutouts 222, 232, at a lower free edge 224, 234 of the inner frame left side panel 220 and the inner frame right side panel 230, respectively. The inner frame 200 can include a pair of approximately vertical outer edges 228, 238.

In accordance with an exemplary embodiment, the right and left panels 220, 230 of the inner frame 200 includes a perforation line 240, which extends from an upper edge 226, 236 to a lower edge 224, 234 of each of the panels 220, 230. In addition, each of perforation lines 240 can include a retention cut 250 on an upper portion of the perforation line 240.

Figure 3:
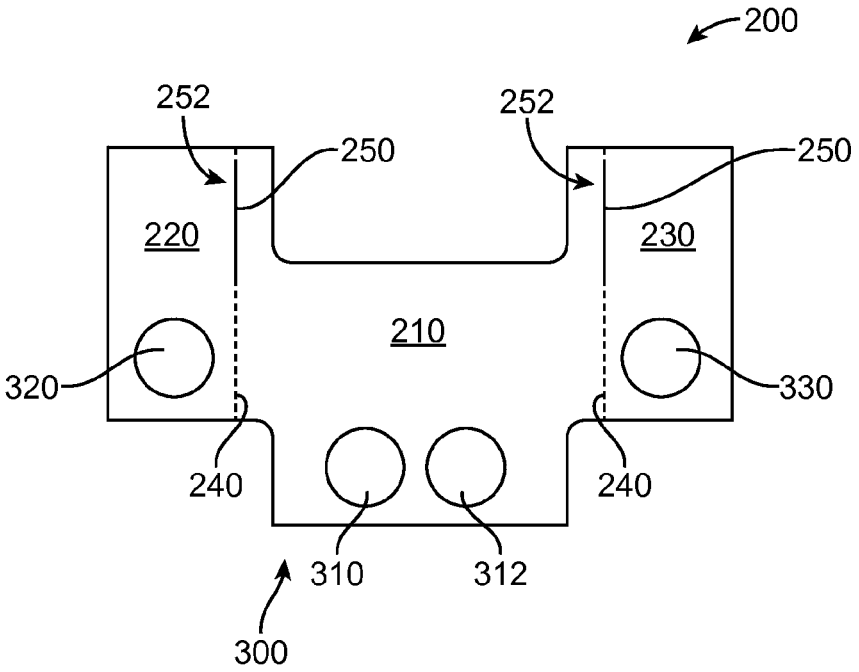
FIG. 3 is a plan view of an inner frame and glue positions before assembly in accordance with an exemplary embodiment.

During assembly of the pack 100, the inner frame 200 can be mounted in the box portion 110 by one or more glue dots 310, 312, 320, 330 (FIG. 3). After assembly of the pack 100 from the laminar blanks and the filling of the pack 100 with the bundle of smoking articles 10, the hinge lid 120 is closed so that the inner surfaces of the hinge lid 120 can be brought into contact with the outer surfaces of the inner frame 200. In order to open the pack 100 for the first time, the consumer may grasp a pull tab (not shown) and pull the hinge lid 120 to break the seal between the hinge lid 120 and the inner frame 200 and to subsequently pivot the hinge lid 120 backwards towards the open position as shown in FIG. 1.

FIG. 3 is a plan view of an inner frame 200 and glue positions 300 before assembly in accordance with an exemplary embodiment. The inner frame 200 is preferably formed from a folded blank, which can be attached or affixed to the box 110 by an adhesive or glue. For example, in accordance with an exemplary embodiment as shown in FIG. 3, the inner frame 200 can be attached to the box 110 using a plurality of glue dots 300. The plurality of glue dots 300, for example, can include at least one glue dot 310, 312, 320, 330, and more preferably, a pair of glue dots 310, 312 located on a lower edge or portion of the inner frame front panel 210. In addition, a left side wall glue dot 320 and a right side wall glue dot 330 can be positioned on the inner frame left side panel 220 and an inner frame right side panel 230, respectively.

Figure 4:
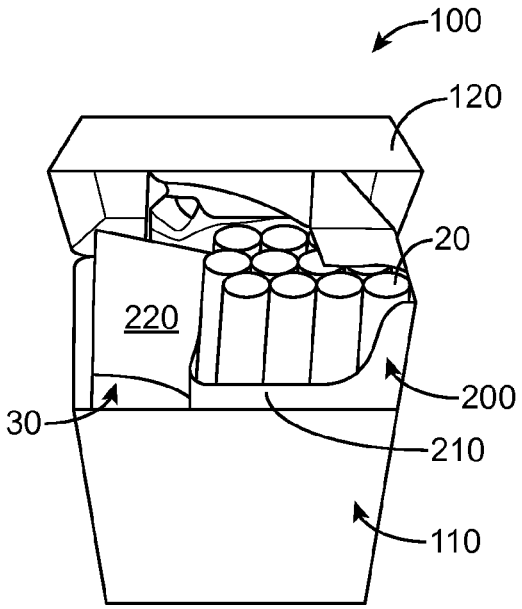
FIG. 4 is a perspective view of an assembled pack with an inner frame in accordance with an exemplary embodiment.

In accordance with an exemplary embodiment, during use, for example, the glue dot 320 between the left side wall 114 of the box 110 and the left panel 220 of the inner frame 200 can be broken, which can allow the pack's inner frame to fold inward, thus containing loose cigarettes (FIG. 4).

The inner frame 200 can provide extra rigidity to the pack 100. This can be accomplished by gluing the inner frame 200 to the pack 100 blank during construction. Glue dots 310, 312, 320, 330 can be applied to the inner frame 200, and the inner frame applied to a blank for a hinge lid pack 100, such that the inner frame 200 is folded along the perforation lines 240, and wherein a lower edge 216 of the front panel 210 of the inner frame 200 extends downward within the front wall 112 of the pack 100 blank as shown in FIG. 1.

In accordance with an exemplary embodiment, the inner frame 200 can assist in keeping the lid 120 of the pack 100 closed during consumer use. For example, the lid 120 of the pack 100 can be partially retained in a closed position by the retention cuts 250 on the perforation line 240 of the inner frame 200. As shown in FIGS. 2 and 3, the retention cuts 250 are shown by the solid lines on the perforation line 240. When the inner frame 200 is folded about the perforation lines 240, the retention cuts 250 can extend outward to create a larger front inner frame face or panel (retention tabs 252), which can help assist with keeping the lid 120 closed through friction.

Figure 9:
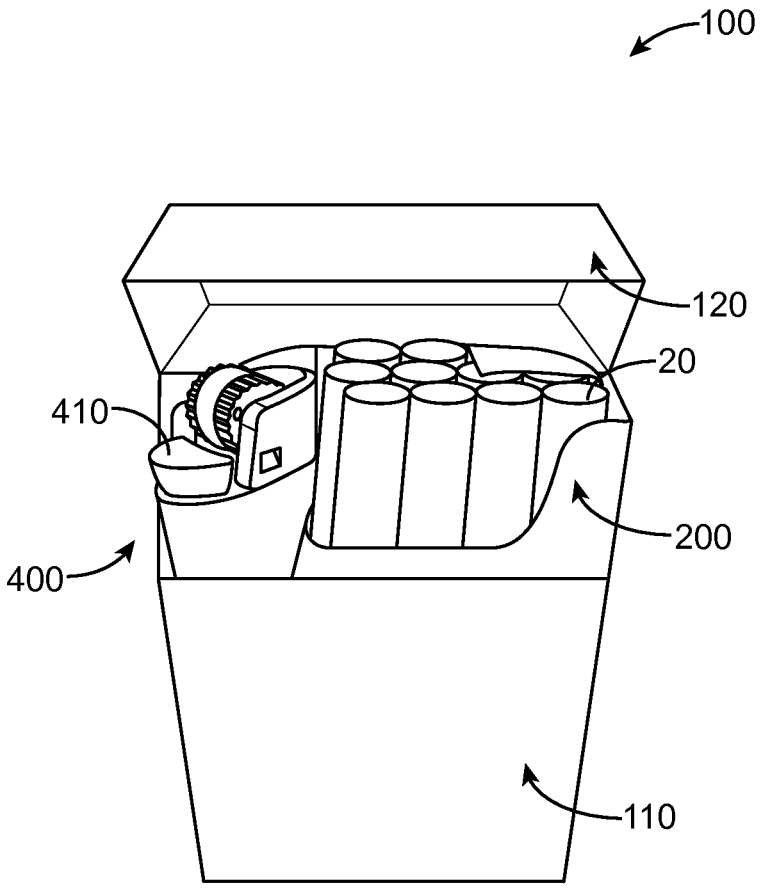
FIG. 9 is a perspective view of a modified pack with a lighter in accordance with an exemplary embodiment.

In accordance with an exemplary embodiment, the inner frame 200 can be folded inward to assist with the containment of loose elongated smoking articles or cigarettes 20. In addition, the containment of loose elongated smoking articles or cigarettes 20 within the pack 100, can result in a reduction in loose tobacco in the pack 100 and damage to the smoking articles or cigarettes 20 in the pack 100. In addition, the pocket or inner cavity 30 created by folding the inner frame 200 inward, upon removal of a portion of the smoking articles 20, can be used, for example, to hold a lighter (FIG. 9).

In accordance with an exemplary embodiment, the position of the inner frame 200 (FIGS. 4 and 5) can be modified within the pack 100 post construction by breaking the seal, for example, the glue dot 310, 312, 320, 330, between the left panel 220 and the left side wall 114 of the box 110, and/or the right panel 230 and the right side wall 116 of the box 110, which can divide the packaging into two areas or cavities, after one or more elongated smoking articles 20, for example, cigarettes, have been removed from the pack 100.

In accordance with an exemplary embodiment, the position of the inner frame 200 can be modified within the finished pack 100, after, for example, a minimum of eight (8) smoking articles 20, for example, cigarettes, have been removed. In accordance with an exemplary embodiment, the modification of the inner frame 200 can be performed by breaking the glue bond 320, 330 between one of the side walls 114, 116 of the box 110, and the corresponding panel 220, 230 of the inner frame 200. In accordance with another exemplary embodiment, rather than breaking the glue bond, the pack 100 can be assembled without one or more glue dots 320, 330, such that a portion of the application of glue dots and/or an adhesive for attaching the inner frame 200 to the blank of the box 110 is removed or eliminated from the production process. In accordance with an exemplary embodiment, once the glue dot 320, 330 is no longer holding the inner frame 200 to the blank of the pack 100, the smoking articles 20 can be aligned, for example, evenly on the other side of the pack 100 and the retention cut 250 on the inner frame 200 can be pressed inward to invert the fold on the perforation line 240. In accordance with an exemplary embodiment, for example, as shown in FIG. 4, this can result in the formerly glued panel 220 being visible as it is pressed against the back of the pack 100. In accordance with an exemplary embodiment, the front panel 210 of the inner frame 200 can act as a dividing wall inside the pack 100 as shown in FIG. 4.

Figure 5:
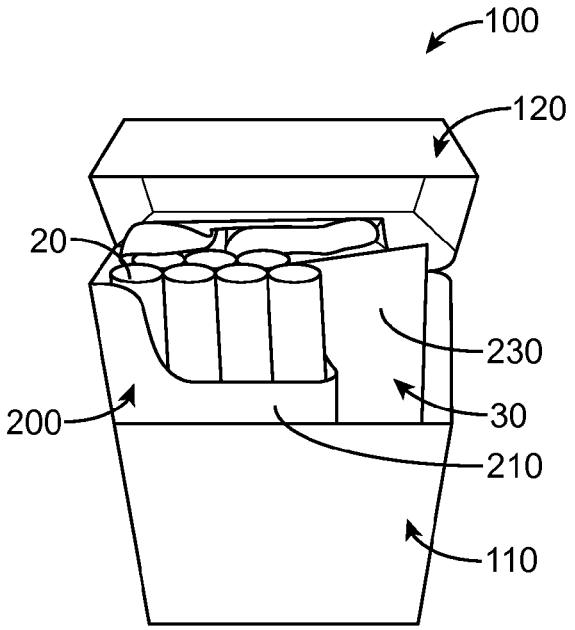
FIG. 5 is a perspective view of an assembled pack with an inner frame in accordance with an exemplary embodiment.

In accordance with an exemplary embodiment, as shown in FIG. 5, the inner frame modification can be done on either side of the pack 100. For example, FIG. 5 illustrates a pack 100 that has been modified on the opposite side or right side, wherein the right glue dot 330 is no longer attaching the inner frame 200 to the blank of the pack 100, and the cigarettes can be aligned on the left side, and a retention tab 252 formed from the retention cut 250 on the inner frame 200 can be pressed to invert the fold on the perforation line 240.

Figure 6:
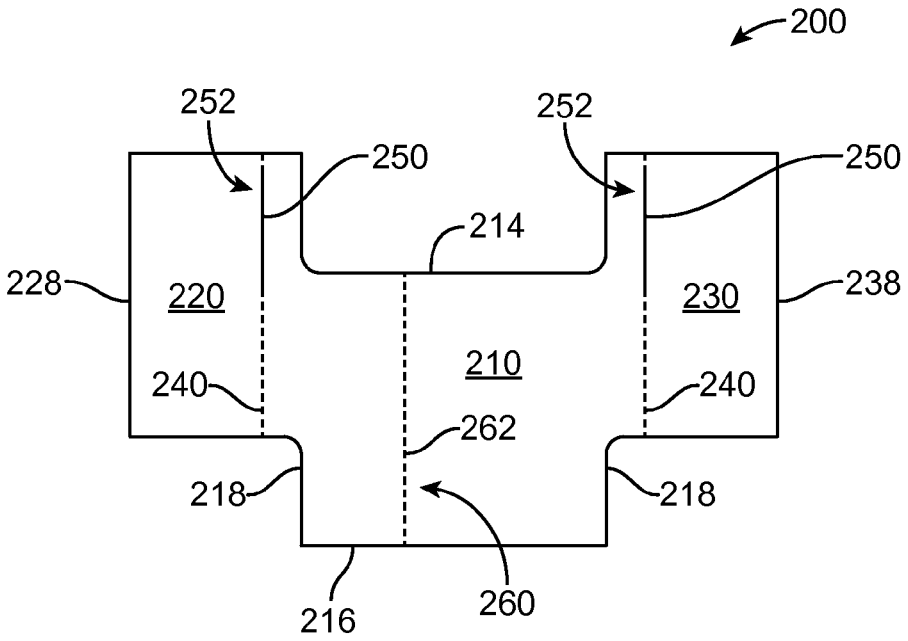
FIG. 6 is a plan view of an inner frame formed from a blank with a fold assist on a front face of an inner frame in accordance with an exemplary embodiment.

FIG. 6 is a plan view of an inner frame 200 with a perforation line 260 on a front panel 210 of an inner frame 200, which can assist with folding the inner frame 200 inward as described above. In accordance with an exemplary embodiment, the front panel 210 of the inner frame 200 can include a series of perforations 262, which form an inner perforation line 260. The inner perforation line 260 can extend from a top edge 214 of the front panel 210 to a lower edge 216 of the front panel 210. In accordance with an exemplary embodiment, the inner perforation line 260 can be located in the front panel 210 of the inner frame 200 on one side or the other side. For example, as shown in FIG. 6, the inner perforation line 260 can be located inward from an inner edge 218 of the inner frame 200 about 25 to 50% of the width of the front panel 210 of the inner frame 200, and more preferably, the distance from one perforation line 240 to the perforation line 260 is equal to a depth of the hinge lid pack 100 from the front wall 112 to the back wall. The inner frame 200 can include two perforation lines 260 (not shown), each of which is located on the front panel 210 at distance from the perforation lines 240 (or outer perforation lines), which is equal to the distance or depth of the hinge lid pack 100 from the front wall to the back wall.

In accordance with an exemplary embodiment, for example, the perforation line 260 can be generated using a knife on a packing module, which can be configured to score the front panel 210 of the inner frame 200 to assist in folding.

Figure 7:
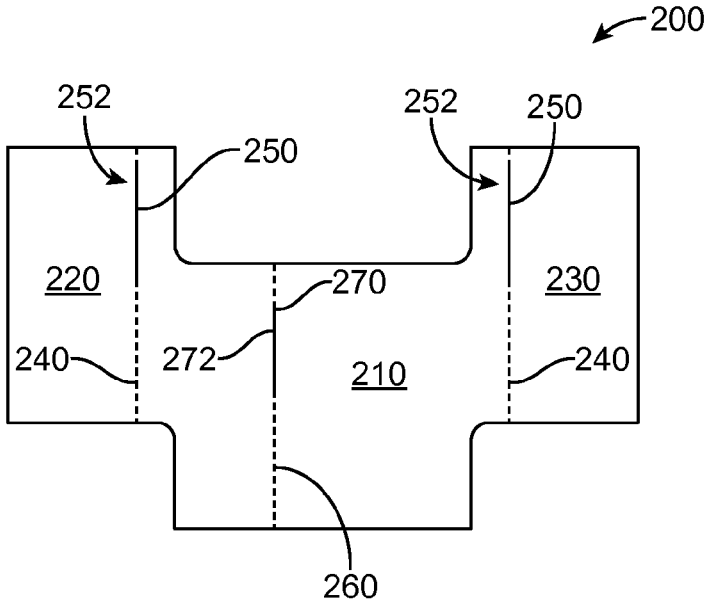
FIG. 7 is a plan view of an inner frame formed from a blank with a fold assist and retention tab on a front face of the inner frame in accordance with an exemplary embodiment.

FIG. 7 is a plan view of an inner frame 200 with a perforation line 260 and a retention cut 270 on a front panel 210 of an inner frame 200. In accordance with an exemplary embodiment, a retention cut 270 can be positioned on an upper portion of the perforation line 260. A retention tab 272 is formed from the retention cut 270. The retention tab 272 on the front panel 210 of the inner frame 200 would be reversed from the other two retention cuts 250 on the inner frame 200 such that when the inner frame 200 is folded the retention tab 272 would protrude or stick out to the front of the pack 200 instead of towards the sides. In addition, the retention tab 272 on the front panel 210 of the inner frame 210 can help in keeping the pack lid 120 closed.

Figure 8:
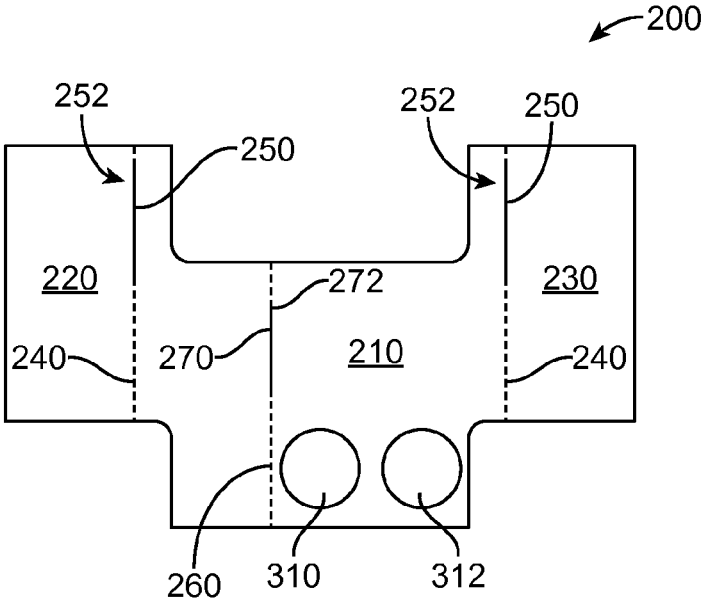
FIG. 8 is a plan view of an inner frame formed from a blank with a pair of glue dots on the front wall of the inner frame, which have been repositioned in accordance with an exemplary embodiment.

FIG. 8 is a plan view of an inner frame with a pair of glue dots on the front wall of the inner frame, which have been repositioned in accordance with an exemplary embodiment. For example, to help create a cleaner fold of the front face of the inner frame 200, one or more of the glue dots 310, 312, can be moved slightly to the right or left of the preformation line 260 in the front panel 210 of the inner frame 200, and/or alternatively, for example, one of the glue dots 320, 330 on the right or left side panel 220, 230, can be eliminated in its entirety.

In accordance with an exemplary embodiment, for example, to help create a cleaner cavity or pocket 30 for a lighter or other small object, it may be desirable to remove the glue dots (not shown), for example, where the foil of wrapped bundle 10 meets the side wall 114, 116 of the pack 100.

In accordance with an embodiment, as the elongated smoking articles 20 are removed from the pack 100, the remaining smoking articles 20 can be free to move around inside the pack 100 which results in tobacco falling out of the smoking articles 20 and/or cause damage to the remaining smoking articles 20. The tobacco that falls out the smoking articles 20 is a direct loss to the consumer and can result in flare-ups from excess paper burning during the lighting process. In addition, the cavity or pocket 30 can hold a small object, for example, a cigarette lighter 400 (FIG. 9).

In accordance with an embodiment, for example, an advantage of placing a lighter 400 in the modified pack 100 as shown in FIG. 9 can be that the red fuel button 410 on the lighter 400 can act as the missing retention tab from the inner frame 200.

It can be appreciated that in addition to the standard King Size pack that has been shown in FIGS. 1-9, the inner frame modification can be incorporated in most pack sizes. For example, the modification to the inner frame 200 can be used with King Size, Long Size, 100's, 120's, and/or 72's packs 100.

Packs 100 according to an embodiment can be in the shape of a rectangular parallelepiped, with right-angled longitudinal and right-angled transverse edges. The pack 100 can comprise one or more rounded longitudinal edges, rounded transverse edges, beveled longitudinal edges or beveled transverse edges, or combinations thereof. Alternatively, the pack 100 may have a non-rectangular transversal cross section, for example polygonal such as triangular or hexagonal, or oval, semi-oval, circular or semi-circular.

Packs 100 according to an embodiment, can be used as packs for elongate smoking articles such as, for example, cigarettes, cigars or cigarillos. It will be appreciated that through appropriate choices of the dimensions thereof, packs 100 can be designed for different numbers of conventional size, king size, super-king size, slim or super-slim cigarettes.

Through an appropriate choice of the dimensions thereof, packs 100 can be designed to hold different total numbers of smoking articles 20, or different arrangements of smoking articles 20. For example, through an appropriate choice of the dimensions thereof, packs 100 can be designed to hold a total of between ten (10) and thirty (30) smoking articles 20. The smoking articles 20 in the pack 100 can be arranged in different collations, depending on the total number of smoking articles. For example, the smoking articles 20 can be arranged in a single row of six, seven, eight, nine or ten smoking articles.

The length, width and depth of packs 100 can be such that, in the closed position, the resultant overall dimensions of the pack 100 are similar to the dimensions of a typical disposable hinge lid pack of twenty cigarettes. For example, packs 100 according to an embodiment can have a height of between about 60 mm and about 150 mm, more preferably a height of between about 70 mm and about 125 mm, wherein the height can be measured from the top wall to the bottom wall of the pack. For example, packs 100 can have a width of between about 12 mm and about 150 mm, more preferably a width of between about 70 mm and about 125 mm, wherein the width can be measured from one side wall to the other side wall of the pack. For example, packs 100 can have a depth of between about 6 mm and about 100 mm, more preferably a depth of between about 12 mm and about 25 mm wherein the depth can be measured from the front wall to the back wall of the pack 100, which includes the hinge between box 110 and lid 120.

As well as housing a bundle of smoking articles, the pack 100 can further include other consumer goods, for example matches, lighters, extinguishing means, breath-fresheners or electronics.

The exterior surfaces of packs 100 according to an embodiment may be printed, embossed, debossed or otherwise embellished with manufacturer or brand logos, trademarks, slogans and other consumer information and indicia.

As used herein, the term "longitudinal" refers to a direction from bottom to top or vice versa of the pack 100 and the inner frame 200. The term "transverse" refers to a direction perpendicular to the longitudinal direction.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a sleeve. Moreover, it will also be apparent to those skilled in the art that various modifications, substitutions, variations, and equivalents exist for claimed features of pack. Accordingly, it is expressly intended that all such modifications, substitutions, variations, and equivalents for claimed features of the pack, which fall within the spirit and scope of the invention as defined by the appended claims, be embraced thereby.

What is claimed is:

1. A hinge lid pack, the hinge lid pack comprising:

a box and a lid, the box having a front wall, a left side wall, a right side wall, a back wall, and a bottom wall, and the lid having a lid top wall, a lid left side wall, a lid right side wall, and a lid back wall; and an inner frame mounted within the box, the inner frame having a front panel, wherein at least a bottom portion of the front panel extends between a right side inner edge and a left side inner edge, a left side panel extending between a left side panel top edge and a left side panel bottom edge, and a right side panel extending between a right side panel top edge and a right side panel bottom edge, the inner frame being foldable such that the left side panel can be proximate to the left side wall of the box, the front panel can be proximate to the front wall of the box and the right side panel can be proximate to the right side wall of the box and wherein the inner frame includes a first perforation line in the front panel, which is configured to allow a portion of the front panel to fold inward to create an inner cavity between the inner frame and the box wherein the first perforation line in the front panel is located inward from an edge of the front panel about 25 % to 50 % of a width of the front panel, wherein the first perforation line in the front panel extends from an upper edge to a lower edge of the inner frame.

2. The pack of claim 1, comprising:

one or more glue dots adhering at least a portion of the inner frame to the front wall of the box of the hinge lid pack.

3. The pack of claim 1, wherein the inner frame includes rectangular cutouts on each side of a lower edge of the inner frame.

* * * * *